United States Patent [19]

Lipski

[11] Patent Number: 4,964,573

[45] Date of Patent: Oct. 23, 1990

[54] SHOWERHEAD ADAPTOR MEANS

[76] Inventor: Pinchas Lipski, 1259 S. Camden Dr., Los Angeles, Calif. 90035

[21] Appl. No.: 369,458

[22] Filed: Jun. 21, 1989

[51] Int. Cl.[5] ..... B05B 15/08

[52] U.S. Cl. ..... 239/283; 239/588; 4/615; 248/75

[58] Field of Search ..... 239/282, 283, 587, 588; 248/75; 4/596, 597, 604, 605, 615; 403/93, 366, DIG. 6

[56] References Cited

U.S. PATENT DOCUMENTS

| | | | |
|---|---|---|---|
| 2,775,424 | 12/1956 | Harris | 403/93 |
| 3,865,310 | 2/1975 | Elkins et al. | 248/75 |
| 3,979,096 | 9/1976 | Zieger | 4/615 |
| 4,463,632 | 8/1984 | Parke | 403/93 |
| 4,719,654 | 1/1988 | Blessing | 239/282 |

FOREIGN PATENT DOCUMENTS

| | | | |
|---|---|---|---|
| 3507290 | 9/1986 | Fed. Rep. of Germany | 4/615 |
| 3539517 | 1/1987 | Fed. Rep. of Germany | 4/596 |

*Primary Examiner*—Andres Kashnikow
*Assistant Examiner*—Karen B. Merritt
*Attorney, Agent, or Firm*—Poms, Smith, Lande & Rose

[57] ABSTRACT

A showerhead adaptor means comprising three integral molded parts, including a middle body member for frictional mounting on a water outlet pipe, a knob on the same axis as that of the body member for frictional grasping of the outlet pipe, a socket receiving member rotatable about the axis of the body member and having a tapered internal surface on an axis intersecting the access of the body member and transverse thereto for receiving a cone shaped coupling member on an end of a flexible tube connected at the other end to the water outlet pipe. The socket member and the coupling member are releasably retained in frictional engagement by a spring biased ball detent means.

1 Claim, 1 Drawing Sheet

Fig. 1.
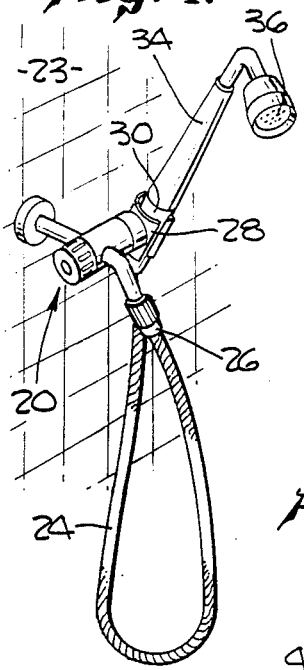
Fig. 7.
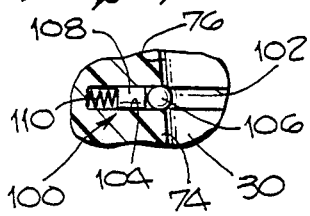
Fig. 4.
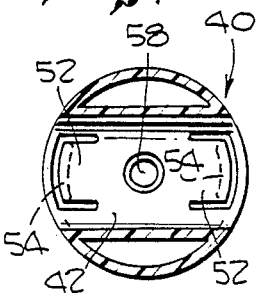
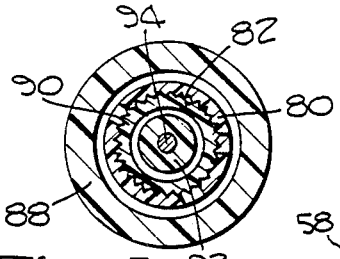
Fig. 5.
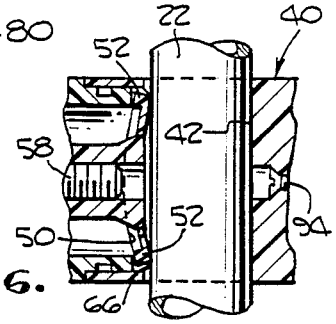
Fig. 6.
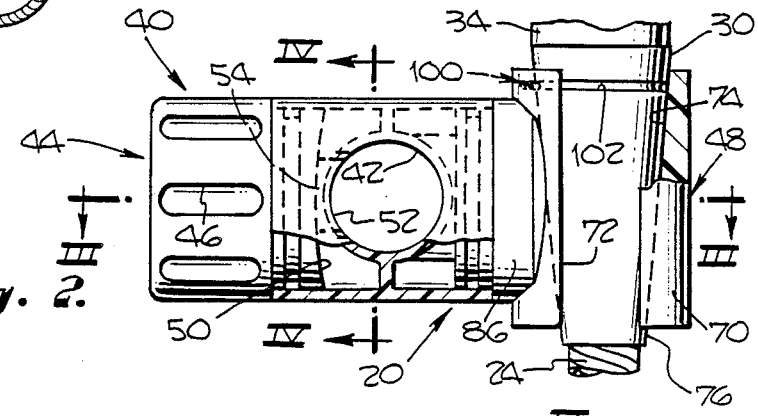
Fig. 2.
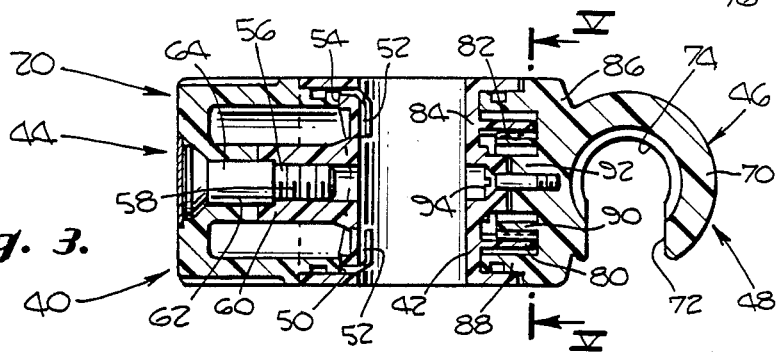
Fig. 3.

SHOWERHEAD ADAPTOR MEANS

BACKGROUND OF INVENTION

This invention relates to a showerhead adaptor means for releasably holding a hand-held showerhead so that the showerhead may be manually manipulated if desired, the showerhead may be used in a fixed position if desired and in such position stored when not in use.

Shower stalls or compartments are frequently made of ceramic tile, metal tile, and often of integral molded plastic shower walls and shower pans. A water outlet pipe protrudes through the shower wall at a selected height from five to six feet, and projects outwardly and downwardly to provide a free externally threaded outlet end to which is usually mounted a showerhead. Such fixed showerheads were provided with universal mountings to direct the stream of water at limited angles from the free end of the outlet pipe.

Since a fixed showerhead has limited adaptability as to the direction of the shower spray, it has been found desirable to attach a showerhead to an elongated handle and connect the end of the handle through a flexible tube of selected length to the water outlet pipe by a suitable coupling. The shower spray of such an elongated showerhead handle may be readily manually directed against the body at different heights and in virtually any selected direction. Since the showerhead is at the end of a handle connected to a flexible tube, various prior proposed devices have been used to store the showerhead when not in use and in some instances temporarily fix the location of the showerhead to direct the shower spray in a desired fixed direction.

One of such prior proposed constructions have included the provision of a vertically extending bar secured to the shower wall in spaced relation thereto and with a device for holding the handle of the showerhead in selected position along the bar. The disadvantages of such a mounting means for a hand-held showerhead are that the mounting of the bar on the sidewall of the shower requires piercing the shower wall with bar securing means In tile walls, care must be used in making a hole to prevent cracking adjacent tiles, and a suitably sized escutcheon plate must be used. In plastic walls, a problem exists in providing a suitably sealed and strong mounting for the bar.

In another prior proposed mounting for a hand-held showerhead, the end of the water pipe is provided with a universal coupling member providing a connection to one end of the flexible tube and also providing a part cylindrical socket for holding the handle of the hand-held showerhead. Such handles are often oval in cross-section and the receiving socket on the universal mounting comprises a longitudinal slot adapted to receive the handle, which is then secured in the slot by slightly turning the handle about its axis. When such a prior construction is used as a fixed showerhead, the adjustment of the direction of the shower stream is relatively limited.

SUMMARY OF THE INVENTION

The present invention contemplates a showerhead adaptor device or means which may be readily attached to and receives the water outlet pipe protruding from the shower wall, and which utilizes the outlet pipe for positioning the hand-held showerhead in storage position and also in a fixed shower spray position. The adaptor means of this invention contemplates convenient adjustment of the adaptor device along the axis of the water outlet pipe to provide limited adjustment heightwise of the device and spacing thereof from the shower wall; rotational adjustment about the axis of the water pipe to position the showerhead at a selected angle; and rotatable adjustment of the showerhead about the axis of the handle to provide further desired positioning of the showerhead to obtain a selected angle of shower spray. In the position selected, the hand-held showerhead may be readily stored when not being manually used to direct the shower spray at various areas of the body.

One of the prime objects of the present invention is to provide a showerhead adaptor for a hand-held showerhead which is simply constructed, readily manufactured of a minimum of integrally formed parts, and readily held in assembly.

An object of the present invention is to provide a showerhead adaptor means utilizing a flow conducting outlet pipe for adjustment lengthwise therealong with some height variation and to provide adjustable spacing from the wall of the shower compartment.

Another object of the invention is to provide a showerhead adaptor device which may be adjustably rotated about the axis of the outlet pipe.

A further object of the invention is to provide a showerhead adaptor device which includes a retainer socket means for a tube coupling adjacent the handle of the hand-held showerhead, in which the handle may be adjustably rotated in a plane spaced from the axis of the pipe, and parallel to the axis of the pipe to provide a selected angle for a shower spray emitted from the shower head.

A still further object of the invention is to provide a showerhead adaptor device which is adjustable about the axis of the handle of the showerhead for directing the shower spray at a selected angle to the mounting wall of the shower.

A still further object of the present invention is to provide a showerhead adaptor device made essentially of three molded parts held in assembly by screw means located on the axis of two of the parts, and in which the handle receptacle and retainer means is symmetrical with respect to a common axis of two of the parts.

The invention also contemplates a showerhead adaptor device in which friction is utilized to retain the hand-held shower device in fixed position to prevent displacement or movement from the selected fixed position by water pressure in the flexible tube and in the handle.

Many other advantages and objects of the present invention will be readily apparent from the following description of the drawings, in which an exemplary embodiment of the invention is shown.

BRIEF DESCRIPTION OF THE DRAWINGS

In the drawings, FIG. 1 is a perspective view of a shower wall with a water outlet pipe and a showerhead adaptor device embodying this invention.

FIG. 2 is an enlarged elevational view of the showerhead device shown in FIG. 1, the view being partly in section to illustrate certain internal features of the device.

FIG. 3 is a sectional view of the device shown in FIG. 2, the section being taken in the plane indicated by line III—III of FIG. 2.

FIG. 4 is a transverse sectional view taken in the plane indicated by line IV—IV of FIG. 2.

FIG. 5 is a transverse sectional view taken in the plane indicated by line V—V of FIG. 3.

FIG. 6 is a fragmentary sectional view taken in the same plane as FIG. 3 and showing frictional securement of the device on an outlet pipe.

FIG. 7 is a fragmentary sectional view of a friction holding device for the coupling at the end of the shower head assembly

DETAILED DESCRIPTION OF THE INVENTION

In FIG. 1, a showerhead adaptor device embodying this invention is generally indicated at 20. The device 20 is mounted on a water outlet pipe 22 which extends outwardly from a shower wall 23 for a selected distance and is downwardly inclined to provide a free externally threaded end. Water flowing through the pipe 22 is controlled by usual hot and cold control valves not shown.

Threadedly attached to the free end of outlet pipe 22 is a flexible tube means 24 of selected length and provided with a coupling means 26 for threaded connection to the end of outlet pipe 22. A coupling means 28 of similar configuration including a tapered or cone-shaped fitting 30 (as shown in FIG. 2) is connected to one end of a handle 34 carrying at its other end a shower head 36 of suitable selected design.

The showerhead adaptor device 20 comprises three integrally molded parts connected by screw means on the common axis of two of the parts. As best seen in FIGS. 2 and 3, the adaptor device comprises a middle body member 40 of cylindrical form having a through bore 42 transverse to the axis of body member 40 and adapted to receive therethrough a portion of outlet pipe 22. At one end of body member 40 is provided a rotatable knob 44 provided with a plurality of longitudinally extending external spaced indentations or flutes 46 to facilitate grasping of the knob 44 for rotation thereof. At the other end of body member 40 is a socket receiving member 48 having an axis intersecting with and normal to the common axis of the body member 40 and knob 44. Socket member 48 is rotatably mounted with respect to the body member 40.

Means for frictionally grasping the outlet pipe 22 in the through bore 42 may comprise a curved edge face 50 on an end portion of knob 44 which is received internally within the cylindrical body member 40. The body member 40 is formed with tabs or tangs 52 each having a curved edge face 54 engageable with the circular curved cam face 50 on the rotatable knob.

The knob 44 may be secured in rotatable relation to the adjacent end of the body member by an internal screw member 56 having a head 62 carried by knob 44 and a threaded portion 58 engageable with threads provided in an outwardly extending nipple 60 formed in the body member. The head 62 is cylindrical and provides a rotatable bearing surface 64 to permit rotation of knob 44 relative to body member 40.

Rotation of knob 44 turns the curved edge cam face 50 about the axis of the body member and knob to cause the cam face 50 to press against edge faces 54 on the tangs 52 and to urge the tangs inwardly of the bore 42 into frictional engagement as at 66 with outlet pipe 22 as shown in FIG. 6.

The receiving socket member 48 comprises a part cylindrical wall 70 having a longitudinally extending opening 72 having a width adapted to receive therethrough a portion of flexible tube 24 to permit entry of the tube and cone-shaped coupling fitting 30 socket member. The socket member is provided with an internally tapered conical surface 74 adapted to receive, by longitudinal movement of the tube end 24, the coupling 28 and/or the adjacent end of handle 30 into the tapered bore. The coupling 28 is thus moved into wedge-type friction engagement with the socket receiving 48. In this respect, it will be understood that a tapered end, as indicated at 76, may be formed on the end of the handle for reception into the member 48 or the tapering cone shape may be included as part of the end coupling 28 of the tube 24. Thus, the showerhead 36 may be firmly held and releasably retained within the socket receiving member 48.

Means for rotating socket member 48 about the common axis of the body member 40 and knob 44 in order to adjustably position the socket member in a plane spaced from and parallel to through bore 42 may comprise a plurality of circularly spaced arcuate fingers 80 provided with longitudinally extending splines 82 on their internal surfaces, said fingers 80 extending in an axial direction from an internal wall 84 formed in the body member. The socket member 48 is provided with a generally cylindrical portion 86 which includes a cylindrical outer wall 88 encircling the fingers 82 and an internal circular wall 90 spaced therefrom. The internal surfaces of fingers 82 are provided with longitudinally extending shallow splines and the circular internal wall 90 of the member 48 is provided with an outer surface with shallow splines engageable with the splines of the fingers 82. The shallow intersplined engagement between body member 40 and socket member 48 permits socket member 48 to be rotated about the axis of body member 40 and releasably frictionally retained in a selected position relative to the through bore 42 of body member 40.

The socket member 48 is held in assembly with the body member by a screw means 94 provided on the axis of the body member 40 and extending axially into the cylindrical portion 92 of socket member 48.

As described above, the cone shaped coupling means 28 having the cone fitting 30 is readily carried by the socket member 48 after the adjacent portion of the flexible tube 24 has been introduced through slot 72 and the tube pulled downwardly so that the cone shaped fitting 30 entering gauges with the internal cone surface 74 of the socket member 48. In some installations such a cone shaped friction fitting is sufficient to hold the shower head in a selected position.

It may also be desirable to releasably secure the cone fitting 30 in the member 48 by further releasable securement means generally indicated at 100 FIG. 7. In this example of a securement means, the fitting 30 may be provided with an annular groove 102 of relatively shallow depth and formed adjacent the large end of the fitting 30 yet within the area of engagement of the cone fitting 30 with the upper end of the tapered internal surface 74 of member 48. Member 48 may be provided with a small diameter transverse hole 104 located opposite the position of the angular groove 102 in fitting 30. Hole 104 receives a spring of biased wall type detent means which may comprise a ball 106 adapted to be biased into the groove 102, a small plunger 108, and a spring 110 of selected force in order to secure the cone shaped fitting 30 in member 48 with sufficient force that the shower head will not be dislocated or displaced from member 48 when a high pressure stream of water is emitted therefrom. The ball detent arrangement permits ready release of the cone-shaped coupling by lifting the handle or the showerhead axially of 48 in a direction away from the narrow end of the tapered fitting.

In the illustration of FIG. 1, the showerhead 36 attached to handle 34 is indicated in a vertical or enclined position. It will be readily apparent that the position of the showerhead may be changed by rotation of the adaptor device 20 about the axis of the water outlet pipe, and may be further adjusted by rotation of the member 48 about its axis common to the axis of the knob and body member 40 and further adjustment by rotation of the handle 34 and coupling 28 about its axis.

In some instances, it may be desirable to rotate member 48 through 180 degrees, so that the large end of the tapered opening is directed downwardly. With the provision of the securement means 100, the showerhead and handle may be located and held in fixed relation downwardly of the axis of the body member and knob of device 20. In such arrangement, the tapered cone fitting 30 is lifted upwardly into the member 48, until the ball detent means engages the groove 102 to secure it in such position. Release of the showerhead and handle from the member 48 is accomplished simply by pulling downwardly until the flexible tube 24 may be moved laterally through the slot 72 in member 48.

Also, in the example shown in FIG. 1, the handle 34 is illustrated as attached by coupling 28 to the flexible tube, one end of the handle having a showerhead 36. In some installations, it may be desirable to eliminate the handle entirely and attach the showerhead directly to the coupling 28 at one end of the flexible tube 24. Elimination of the handle will not affect the operation of the showerhead adaptor device 20.

It will be understood that various changes and modifications may be made in the showerhead adaptor device described above, which fall within the spirit of this invention, and all such changes and modifications coming within the scope of the appended claims are embraced thereby.

I claim:

1. In a readily adjustable shower head adaptor device for use with a water outlet pipe and having a showerhead handle, a showerhead at one end of the handle, and a flexible tube interconnecting the handle and the outlet pipe for fluid communication between the showerhead and the outlet pipe, the combination:

an elongated cylindrical body member having a longitudinal axis and having a throughbore transverse to said longitudinal axis for adjustably lengthwise receiving the outlet pipe and for pivotal adjustment about the axis of the outlet pipe;

friction means within said body member for frictional contact with the said outlet pipe;

means at one end of the body member for moving said friction means in the direction of the longitudinal axis of said body member to cause releasable frictional contact with the pipe for securing the device in a selected longitudinal and rotational position on the pipe;

handle retaining means at the other end of the body member mounted for pivotal movement about the longitudinal axis of the body member; and screw means along the longitudinal axis of the body member for holding the handle retaining means, body member, friction means, and means for moving said frictional means in assembly with the water pipe.

* * * * *